US006705894B1

(12) United States Patent
Comerci et al.

(10) Patent No.: US 6,705,894 B1
(45) Date of Patent: Mar. 16, 2004

(54) SHIELDED ELECTRICAL CONNECTOR

(75) Inventors: Joseph D. Comerci, Elmhurst, IL (US); Magdalena M. Carranza, Wheaton, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 10/335,716

(22) Filed: Jan. 2, 2003

(51) Int. Cl.[7] ..... H01R 13/00
(52) U.S. Cl. ..... 439/607; 439/76.1
(58) Field of Search ..... 439/607, 609, 439/610, 465, 466, 687, 696, 731, 76.1, 467

(56) References Cited

U.S. PATENT DOCUMENTS

| | | | | |
|---|---|---|---|---|
| 4,582,384 A | | 4/1986 | Frantz et al. | 339/143 |
| 4,585,292 A | | 4/1986 | Frantz et al. | 339/143 |
| 4,689,723 A | | 8/1987 | Myers et al. | 361/424 |
| 5,092,794 A | | 3/1992 | Kachlic | 439/607 |
| 5,158,481 A | | 10/1992 | Frantz | 439/607 |
| 5,273,459 A | * | 12/1993 | Davis | 439/607 |
| 5,380,223 A | * | 1/1995 | Marsh et al. | 439/610 |
| 5,409,400 A | * | 4/1995 | Davis | 439/610 |
| 5,505,637 A | * | 4/1996 | Kramer et al. | 439/610 |
| 5,820,412 A | * | 10/1998 | Koegel et al. | 439/610 |
| 5,836,774 A | * | 11/1998 | Tan et al. | 439/76.1 |
| 6,257,914 B1 | * | 7/2001 | Comerci et al. | 439/357 |

FOREIGN PATENT DOCUMENTS

| | | | |
|---|---|---|---|
| EP | 0 125 498 B1 | 11/1984 | H01R/13/502 |
| EP | 0 649 191 A1 | 4/1995 | H01R/13/658 |

* cited by examiner

*Primary Examiner*—Ross Gushi
(74) *Attorney, Agent, or Firm*—Stephen Z. Weiss

(57) ABSTRACT

An electrical connector assembly includes an inner connector defining a front-to-rear mating axis and mounting a plurality of conductive terminals. An outer shell is disposed about the inner connector and includes a pair of backshell halves. Each backshell half has a latch bar extending radially of the mating axis and a latch arm extending axially of the mating axis. The latch bar and the latch arm are at opposite sides of the backshell half. The latch bar and the latch arm are constructed to be complementarily engageable so that the axially extending latch arm of one backshell half is engaged with the radially extending latch bar of the other backshell half to latch the backshell halves together and form the outer shell about the inner connector.

18 Claims, 4 Drawing Sheets

SHIELDED ELECTRICAL CONNECTOR

FIELD OF THE INVENTION

This invention generally relates to the art of electrical connectors and, particularly, to a shielded electrical connector which has a pair of shielding backshell halves which may be hermaphroditic.

BACKGROUND OF THE INVENTION

A typical electrical connector includes some form of dielectric housing or insert which mounts a plurality of conductive terminals. The terminals may be terminated to discrete electrical wires or conductors of a composite electrical cable. The terminals have contact portions generally at a front mating end or face of the connector for electrically engaging the terminals of a complementary mating connector at a mating interface.

In many electrical connector applications, such as in the telecommunication and/or data communication industries, an electrical connector typically includes some form of metal shroud or shield surrounding the electrical terminals or a least the contact portions of the terminals at the mating interface. The shroud or shield provides electromagnetic interference and/or radial frequency interference (EMI/RFI) protection for the connector. In some connectors, the metal shroud or shield is provided by a pair of outer shell members which are interconnected about the interior dielectric and terminals of the connector. The shell members have some form of means for holding the shells together about the connector. For instance, fasteners such as screws may be used, but such fasteners require inventory maintenance and the assembly of such fasteners is not cost and time effective. Some shell halves have thin interengaging hooks, which are susceptible to breakage, and if the backshell halves are of die cast material, expensive side action molds are required in addition to a single pull mold. The present invention is directed to solving these various problems by providing a new and improved interconnection system between a pair of shell halves in such a shielded electrical connector.

SUMMARY OF THE INVENTION

An object, therefore, of the invention is to provide an electrical connector with improved backshell halves which provide easy assembly and robust retention.

In the exemplary embodiment of the invention, an electrical connector assembly includes an inner connector defining a front-to-rear mating axis and including a plurality of conductive terminals. An outer shell is provided about the inner connector and includes a pair of backshell halves. Each backshell half includes a latch bar extending radially of the mating axis and a latch arm extending axially of the mating axis. The latch bar and the latch arm are at opposite sides of the backshell half and are constructed to be complementarily engageable so that the axially extending latch arm of one backshell half is engaged with the radially extending latch bar of the other backshell half to latch the backshell halves together and form the outer shell about the inner connector.

In the preferred embodiment, the backshell halves are hermaphroditic. The backshell halves preferably are fabricated of die cast metal material, such as a zinc alloy.

According to one aspect of the invention, the connector assembly includes a front shell around a front mating end of the inner connector. The backshell halves include front portions embracing at least a portion of the front shell. As disclosed herein, the front portions of the backshell halves are enlarged to define cavity halves which combine to define an enlarged shell cavity for embracing the front shell.

According to another aspect of the invention, a pair of jack screws are journalled in the outer shell for securing the electrical connector assembly to a mating connecting device. Each backshell half includes a pair of journal portions at the opposite sides thereof, whereby the latched backshell halves combine to form a pair of journal structures for the pair of jack screws at opposite sides of the outer shell. The latch bar and the latch arm of the backshell halves are formed on the journal portions.

According to a further aspect of the invention, fastening means are provided rearwardly of the latch bars and the latch arms to hold the backshell halves about the inner connector. As disclosed herein, the fastening means comprise a pair of fasteners, such as bolts, at the opposite sides of the backshell halves.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
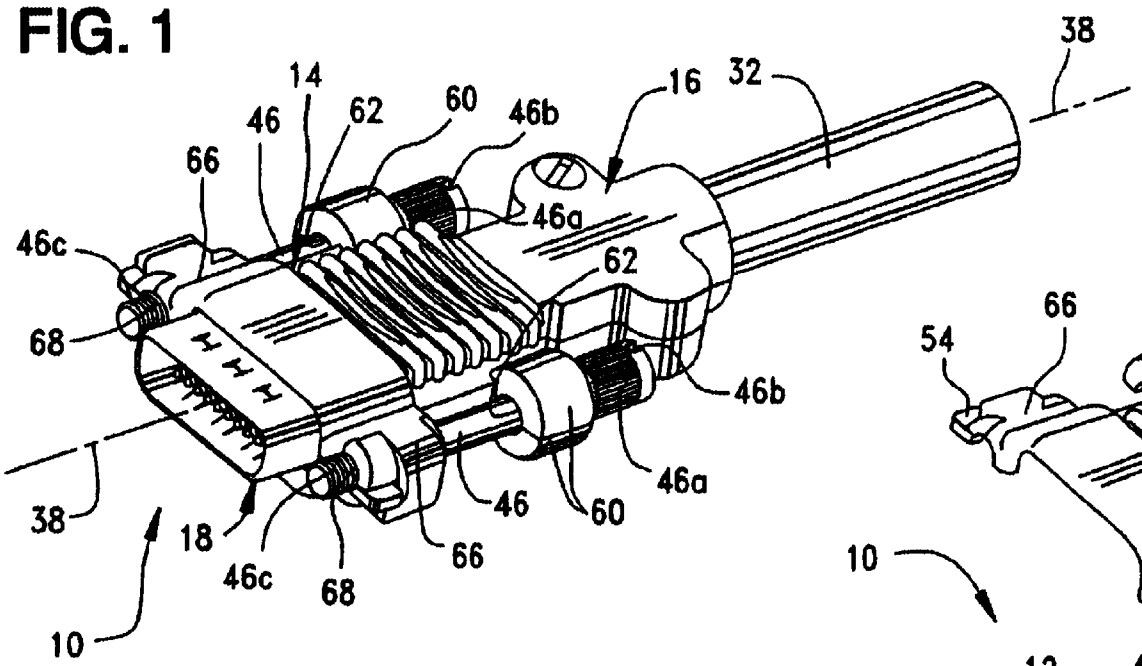
FIG. 1 is a front perspective view of an electrical connector assembly embodying the concepts of the invention.
Figure 2:
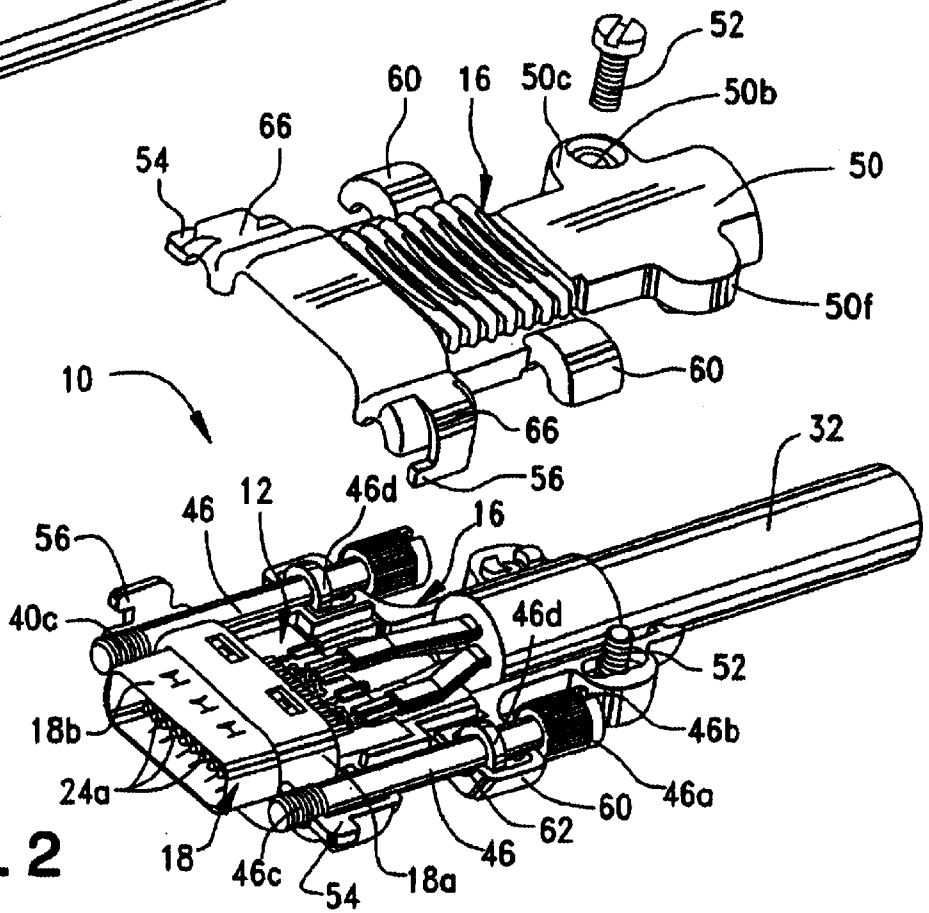
FIG. 2 is a view similar to that of FIG. 1, with the top backshell half removed from the remainder of the connector assembly.
Figure 3:
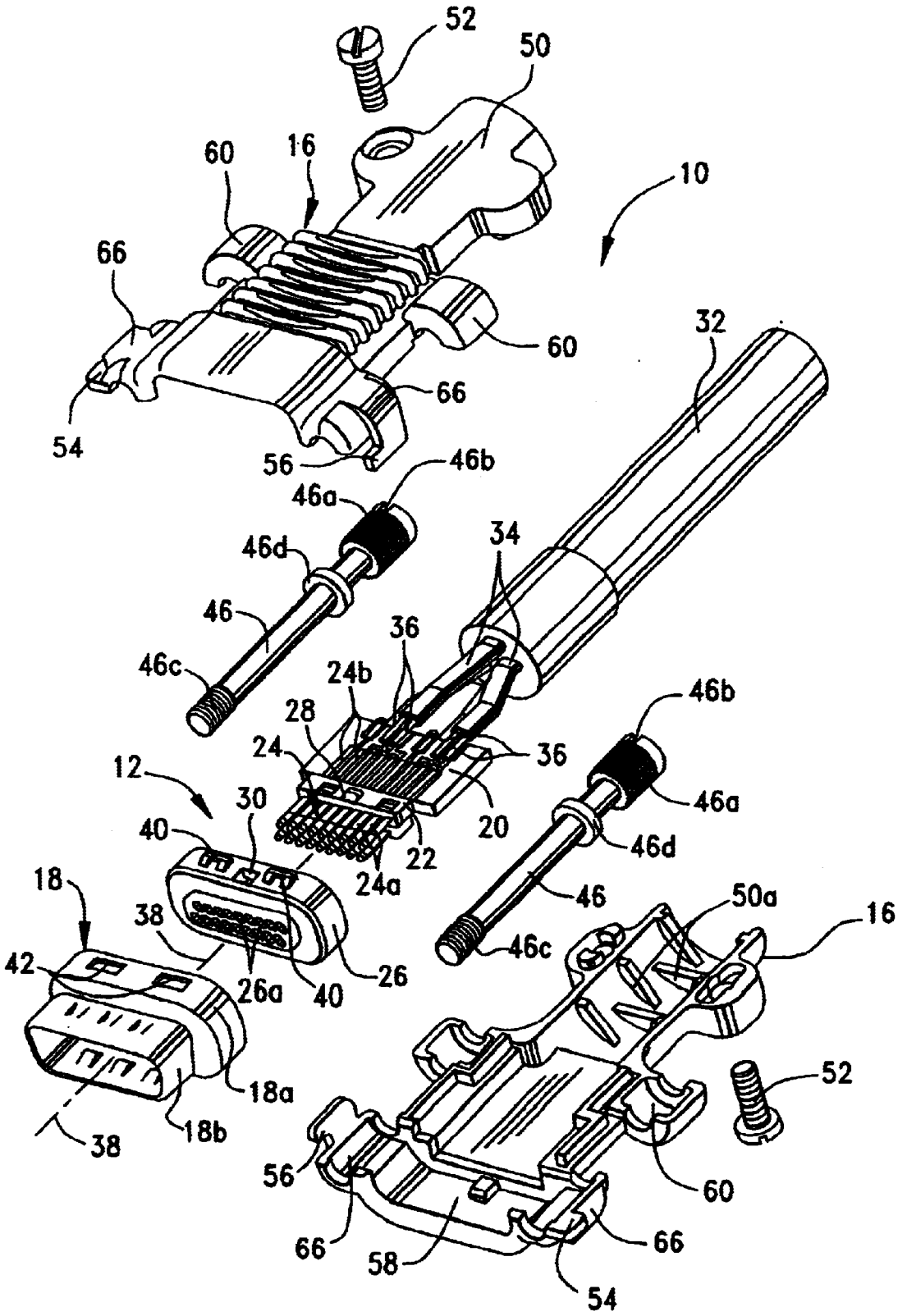
FIG. 3 is an exploded perspective view showing the components of the connector assembly.

Referring to the drawings in greater detail, and first to FIGS. 1–3, the invention is embodied in an electrical connector assembly, generally designated 10 (FIG. 1), which includes an inner connector, generally designated 12 (FIGS. 2 and 3), surrounded by an outer shell, generally designated 14 (FIG. 1). The outer shell is provided by a pair of backshell halves, generally designated 16, along with a front shell, generally designated 18. In the preferred embodiment, backshell halves 16 are hermaphroditic and are fabricated of die cast material, such as a zinc alloy.

As best seen in FIG. 3, inner connector 12 includes a dielectric wire management plate 20 having a front housing portion 22 which mounts a plurality of conductive terminals, generally designated 24. The terminals have forwardly projecting pin portions 24*a* and rearwardly projecting tail portions 24*b* which are properly spaced on wire management plate 20. A front pin aligner 26 of dielectric material is positioned over terminal pin portions 24*a* which extend through passages 26*a* in the pin aligner. The pin aligner is snappingly engaged with housing portion 22 of wire management plate 20 by means of a pair of top and bottom latch bosses 28 on the housing portion snapping into a pair of latch openings 30 on both the top and bottom of the pin aligner.

A composite electrical cable 32 includes a plurality of electrical wires 34. Each electrical wire includes a plurality of discrete conductors 36. The conductors are electrically connected, as by soldering, to tail portions 24*b* of terminals 24. Alternatively, wire management plate 20 could be a circuit board, with conductors 36 connected, as by soldering, to circuit traces on the board which, in turn, are connected to terminal tails 24*b*. Inner connector 12 effectively defines a front-to-rear mating axis 38 which is generally coincident with the longitudinal central axis of electrical cable 32.

Front shell 18 of electrical connector assembly 10 is fitted over the front mating end of inner connector 12 as seen best in FIG. 2. The front shell includes an enlarged rear portion 18*a* which is sized to fit over dielectric pin aligner 26 of the inner connector. A smaller front portion 18*b* of the front shell forms a shroud which completely surrounds terminal pins 24*a* as can be seen in FIG. 2. Therefore, when connector assembly 10 is mated with a complementary mating connector (i.e., terminal pins 24*a* are inserted into complementary female terminals), front shell 18 will surround the mating interface between the connectors. The front shell is attached to pin aligner 26 by means of a pair of latch bosses 40 on both the top and bottom of the pin aligner snap-latchingly engaging within a pair of latch apertures 42 in both the top and bottom of enlarged rear portions 18*a* of front shell 18.

Before proceeding with a description of backshell halves 16, FIGS. 1–3 show that the backshell halves, when interengaged as seen in FIG. 1, journal a pair of jack screws 46. As is known in the art, the jack screws have serrated enlarged heads 46*a* at the rear ends thereof for manual grasping and rotating the jack screws. In addition, heads 46*a* may have slots 46*b* for receiving an appropriate tool, such as a screwdriver, for rotating the jack screws. The front distal ends 46*c* of the jack screws are externally threaded. Finally, the particular jack screws shown herein have radially projecting ring portions 46*d* at a particular location inwardly of heads 46*a*. In certain applications, the mating connector which mates with inner connector 12 is mounted in a panel, such as the rear panel of a computer or other appliance. Jack screws 46 are used to thread distal ends 46*c* into appropriate holes in the panel to secure connector assembly 10 to the panel in mating condition with the complementary mating connector. Alternatively, the jack screws could be threaded directly into a complementary mating connector.

Figure 4:
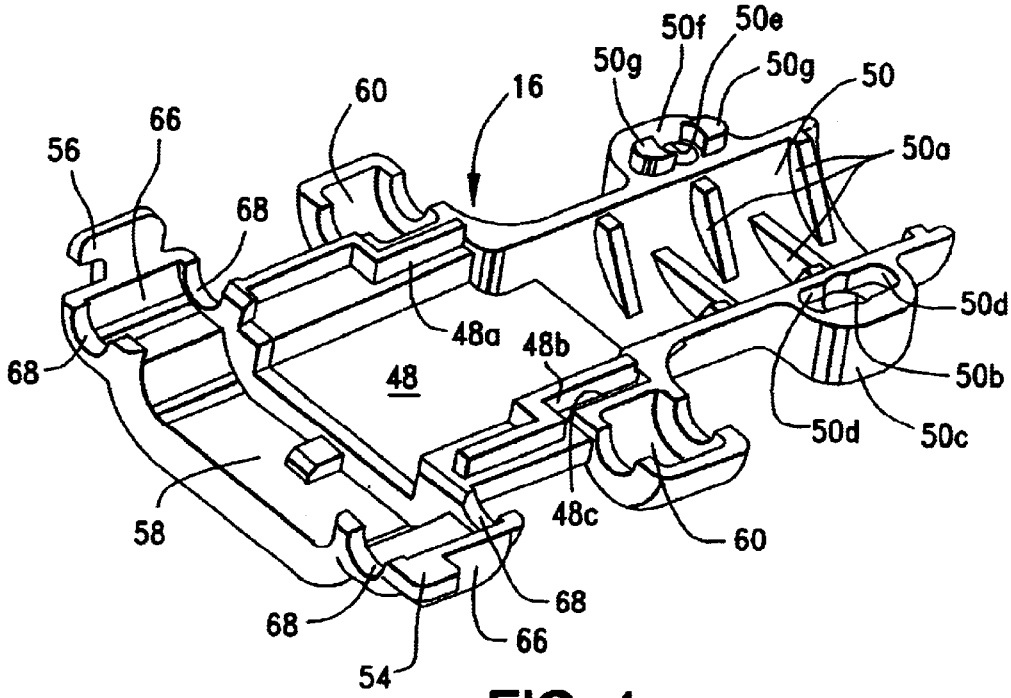
FIG. 4 is a perspective view looking at the inside of one of the hermaphroditic backshell halves.

Referring to FIG. 4 in conjunction with FIGS. 1–3, each hermaphroditic backshell half 16 includes a generally flat body 48 which has a pair of positioning ribs 48*a* and 48*b* at opposite sides thereof. A positioning groove 48*c* is formed outside positioning rib 48*b*. When the hermaphroditic backshell halves are assembled to each other, positioning rib 48*b* of one backshell is positioned inside positioning rib 48*a* of the other backshell half, and positioning rib 48*a* of the other backshell half moves into positioning groove 48*c* of the one backshell half.

Each hermaphroditic backshell half 16 includes a strain relief portion 50 projecting rearwardly of body portion 48 and die cast integrally therewith. A plurality of transversely extending strain relief ribs 50*a* clamp onto the outside of electrical cable 32 when the backshell halves are assembled as seen in FIG. 1. Generally, fastening means are provided at the rear of the backshell halves to securely hold the backshell halves in assembly. Specifically, a free hole 50*d* is formed in a laterally extending boss 50*c* at one side of the backshell half as seen clearly in FIG. 4. A pair of diametrically opposite recesses 50*d* are formed at opposite front-to-rear sides of free hole 50*b*. A hole 50*e* is formed in another boss 50*f* projecting from the opposite side of the backshell half. A pair of positioning tabs 50*g* are located at opposite front-to-rear sides of hole 50*e*. When the backshell halves are assembled, positioning tabs 50*g* of one backshell half enter recesses 50*d* of the other backshell half, while free holes 50*b* of the respective backshell halves are aligned with holes 50*e*. Therefore, a pair of externally threaded bolts 52 (FIGS. 2 and 3) can be inserted through free holes 50*b* and threaded into holes 50*e* to securely hold the two backshell halves in assembly.

Still referring particularly to FIG. 4 in conjunction with FIGS. 1–3, the invention contemplates a unique latching system to latch hermaphroditic backshell halves 16 in assembly. Specifically, a latch bar 54 extends outwardly from one side of each backshell half at the front end thereof. A latch arm 56 extends forwardly of the backshell half at the opposite side thereof. In essence, latch bar 54 extends radially outwardly of mating axis 38 of the connector assembly, and latch arm 56 extends axially forwardly, generally parallel to the mating axis. With the backshell halves being fabricated of die cast metal material, it can be seen in FIG. 4 that latch bar 54 and latch arm 56 can be made thick and quite robust and not susceptible to breakage. The entire structure of backshell halves 16 allow each backshell half to be die cast by two simple separable molds.

Figure 5:
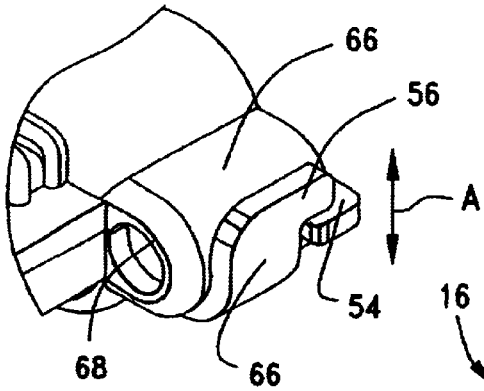
FIG. 5 is a fragmented perspective view looking at the latching area between the backshell halves which form the front journal for one of the jack screws.
Figure 6:
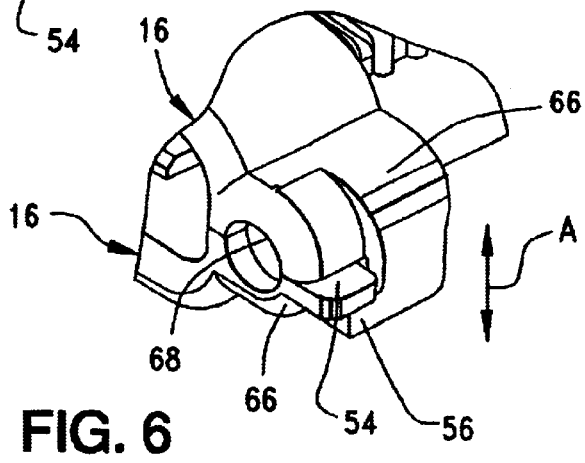
FIG. 6 is a fragmented perspective view looking at the front of the same area as FIG. 5, but at the opposite side of the connector assembly.

FIGS. 5 and 6 show different perspective views of how latch arm 56 is formed sort of circumferentially and then extends forwardly to overlap a back side of latch bar 54. This interengagement prevents the backshell halves from separating out of assembly in the direction of double-headed arrows "A".

As best seen in FIGS. 3 and 4, the front end of each backshell half is provided with a cavity half 58 which, when the backshell halves are assembled, combine to define an enlarged shell cavity for embracing enlarged rear portion 18*a* (FIG. 3) of front shell 18. This further facilitates holding the entire assembly together.

Each backshell half includes a pair of jack screw journal halves 60 at opposite sides thereof intermediate opposite front and rear ends of the backshell half. When the backshell halves are assembled as seen in FIG. 1, journal halves 60 combine to form holes 62 through which jack screws 46 are journalled intermediate opposite ends of the connector assembly. FIG. 2 shows that enlarged rings 40*d* of the jack screws are located within journal halves 60, but the rings are larger in diameter than hole 62. Therefore, the rings can abut opposite ends or sides of the interior of the journal halves to define front and rear limit positions of the jack screws axially thereof.

A pair of jack screw journal halves 66 also are formed at opposite sides of each backshell half 16 at the very front thereof. When the backshell halves are assembled as shown in FIG. 1, journal halves 66 define holes 68 through which the front externally threaded distal ends 46*c* of the jack screws extend.

FIGS. 1, 5 and 6 show a significant feature of the invention wherein latch bars 54 and latch arms 56 are formed at the outer surfaces of front journal halves 66 for jack screws 46. This saves considerable axial space on the jack screw halves and thereby shortens the entire connector assembly. In other words, the latching system provided by latch bars 54 and latch arms 56 are not located at separate axial locations from front journals 66 for the jack screws.

Figure 7:
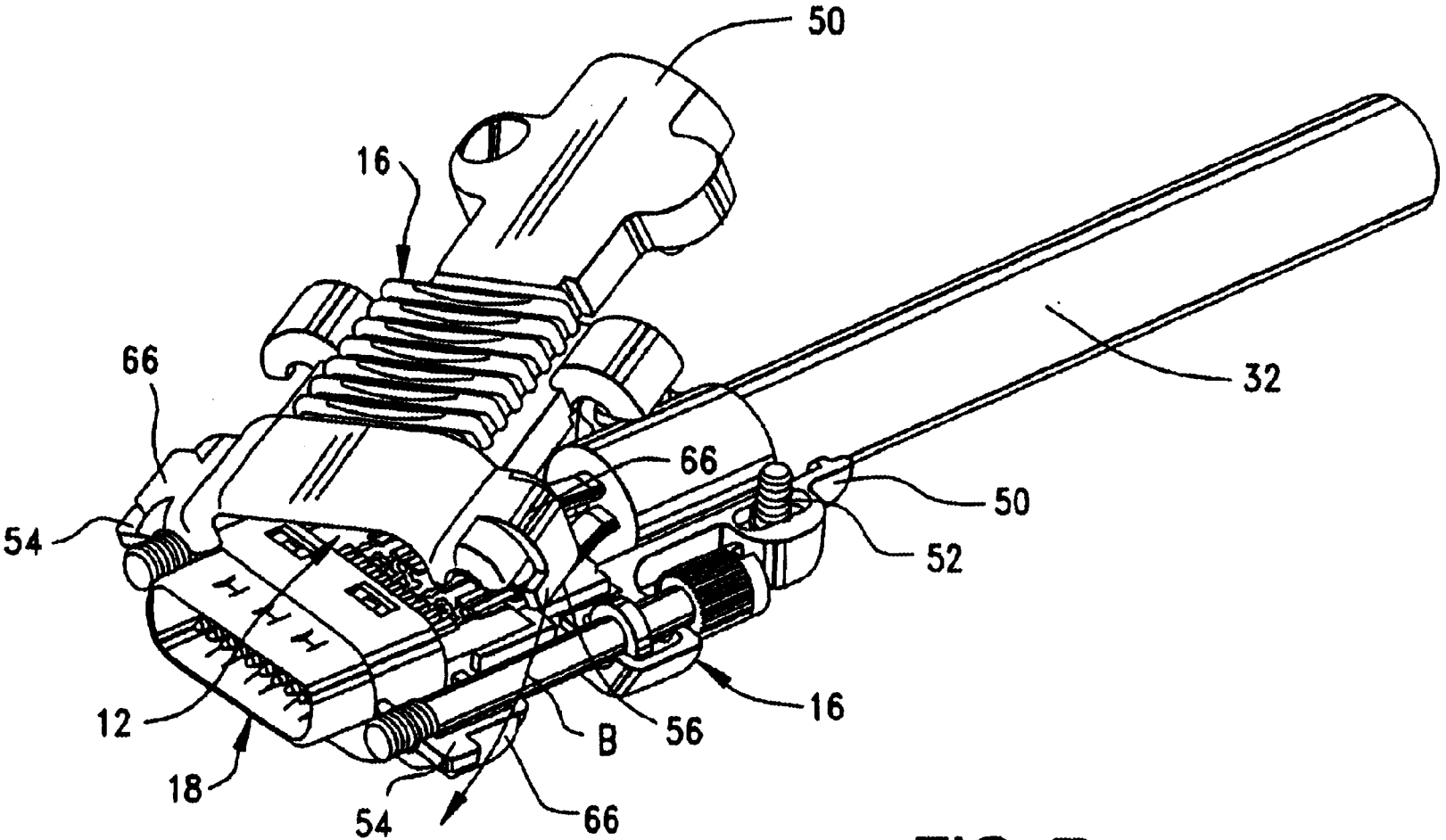
FIG. 7 is a view somewhat similar to that of FIG. 2, but showing the top backshell half in the process of being assembled to the bottom backshell half about the inner connector.

Finally, FIG. 7 shows how backshell halves 16 are assembled by interengaging latch bars 54 and latch arms 56. During assembly, inner connector 12 is terminated to electrical cable 32, front shell 18 and jack screws 46 are assembled into one of the backshell halves as seen best in FIG. 2. The second or top backshell half then is positioned as shown in FIG. 7 so that latch bar 54 of the top backshell half interengages beneath latch arm 56 of the bottom backshell half. This can be accomplished by cocking the top backshell half as seen in FIG. 7 and slightly lowering the backshell half. Once latch bar 54 of the top backshell half is aligned with latch arm 56 of the bottom backshell half, the top backshell half then is rotated downwardly and forwardly so that latch arm 56 moves in the direction of arrow "B" to a position beneath latch bar 54 of the bottom backshell half. Once the backshell halves are assembled and securely latched at the front ends thereof by latch bars 54 and latch arms 56, fastening bolts 52 are used at the rear of the backshell halves to completely hold the backshell halves in the final assembly of electrical connector assembly 10.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

an inner connector defining a front-to-rear mating axis and including a plurality of conductive terminals; and an outer shell about the inner connector and including a pair of backshell halves, each backshell half including a latch bar extending radially of said mating axis and a latch arm extending axially of said mating axis, the latch bar and the latch arm being at opposite sides of each backshell half and being constructed to be complementarily engageable so that the axially extending latch arm of one backshell half is engaged with the radially extending latch bar of the other backshell half to latch the backshell halves together and form the outer shell about the inner connector.

2. The electrical connector assembly of claim 1 wherein said backshell halves are hermaphroditic.

3. The electrical connector assembly of claim 1 wherein said backshell halves are fabricated of die cast metal material.

4. The electrical connector assembly of claim 1, including a front shell around a front mating end of said inner connector.

5. The electrical connector assembly of claim 4 wherein said backshell halves include front portions embracing at least a portion of said front shell.

6. The electrical connector assembly of claim 5 wherein said front portions of the backshell halves are enlarged to define cavity halves which combine to define an enlarged shell cavity for embracing the front shell.

7. The electrical connector assembly of claim 1, including fastening means rearwardly of said latch bars and latch arms to hold the backshell halves about the inner connector.

8. The electrical connector assembly of claim 7 wherein said fastening means comprise a pair of fasteners at said opposite sides of the backshell halves.

9. The electrical connector assembly of claim 1, including a pair of jack screws journalled in said outer shell for securing the electrical connector assembly to a mating connecting device.

10. The electrical connector assembly of claim 9 wherein each backshell half includes a pair of journal portions at said opposite sides thereof whereby the latched backshell halves combine to form a pair of journal structures for the pair of jack screws at opposite sides of the outer shell.

11. The electrical connector assembly of claim 8 wherein said latch bar and said latch arm are formed on said journal portions of the backshell halves.

12. An electrical connector assembly, comprising:

an inner connector defining a front-to-rear mating axis and including a plurality of conductive terminals;

a front shell around a front mating end of said inner connector;

an outer shell about the inner connector and including a pair of hermaphroditic backshell halves, the backshell halves having front portions embracing at least a portion of said front shell, each backshell half including a latch bar extending radially of said mating axis and a latch arm extending axially of said mating axis, the latch bar and the latch arm being at opposite sides of each backshell half and being constructed to be complementarily engageable so that the axially extending latch arm of one backshell half is engaged with the radially extending latch bar of the other backshell half to latch the backshell halves together and form the outer shell about the inner connector; and fastening means rearwardly of said latch bars and latch arms to hold the backshell halves about the inner connector.

13. The electrical connector assembly of claim 12 wherein said front portions of the backshell halves are enlarged to define cavity halves which combine to define an enlarged shell cavity for embracing the front shell.

14. The electrical connector assembly of claim 12 wherein said fastening means comprise a pair of fasteners at said opposite sides of the backshell halves.

15. The electrical connector assembly of claim 12 wherein said backshell halves are fabricated of die cast metal material.

16. The electrical connector assembly of claim 12, including a pair of jack screws journalled in said outer shell for securing the electrical connector assembly to a mating connecting device.

17. The electrical connector assembly of claim 16 wherein each backshell half includes a pair of journal portions at said opposite sides thereof whereby the latched backshell halves combine to form a pair of journal structures for the pair of jack screws at opposite sides of the outer shell.

18. The electrical connector assembly of claim 17 wherein said latch bar and said latch arm are formed on said journal portions of the backshell halves.

* * * * *